US005409192A

United States Patent [19]

Oliver

[11] Patent Number: 5,409,192

[45] Date of Patent: Apr. 25, 1995

[54] LOAD EQUALIZER PIER HEAD

[76] Inventor: James Oliver, 1990-D McCulloch Blvd., #110, Lake Havasu City, Ariz. 85403

[21] Appl. No.: 105,180

[22] Filed: Aug. 12, 1993

[51] Int. Cl.[6] ..... F16M 13/00

[52] U.S. Cl. ..... 248/577; 52/169.6; 248/581; 248/357

[58] Field of Search ..... 248/577, 576, 581, 602, 248/680, 357, 228; 52/169.6, 127.2, 126.6, 126.5; 254/100, 101, 98, DIG. 4

[56] References Cited

U.S. PATENT DOCUMENTS

| | | | |
|---|---|---|---|
| 813,318 | 2/1906 | McCarthy | 248/357 X |
| 2,115,824 | 5/1938 | McRorey | 254/98 |
| 3,606,704 | 5/1969 | Denton | 52/126.2 X |
| 3,713,259 | 1/1973 | Tkach | 52/126.6 X |
| 3,782,052 | 1/1974 | Vetovitz | 52/127.2 X |
| 3,828,491 | 8/1974 | Koon et al. | 254/100 X |
| 4,866,797 | 1/1989 | Vollar | 52/126.6 |
| 4,882,887 | 11/1989 | Giles et al. | 248/228 X |
| 4,895,335 | 1/1990 | Oliver | 254/100 X |

FOREIGN PATENT DOCUMENTS

| | | | |
|---|---|---|---|
| 1012520 | 7/1952 | France | 248/357 |

*Primary Examiner*—Karen J. Chotkowski
*Attorney, Agent, or Firm*—Calif Tervo

[57] ABSTRACT

A load equalizing pier for a coach comprises a stand for placement on the ground and a head for placement under a load, e.g. a coach beam. The stand includes means for adjusting the height of the head. The head includes a base plate for attachment to the top of the stand and a support plate for placement under the load. Springs, supported by the base plate bias the support plate toward a biased position separated from the base plate. Bolts retain the support plate to the base plate above the base plate such that the support plate is movable downward from a biased position to a stop position restrained by the base plate. The springs apply a biasing force less than the desired load such that said support plate, under desired load, is restrained from further downward movement by said base plate. Preferably, the springs apply a biasing force of less than half of the desired load.

7 Claims, 1 Drawing Sheet

LOAD EQUALIZER PIER HEAD

BACKGROUND OF THE INVENTION

1. Field of the Invention

This invention relates generally to piers for supporting a mobile home coach and more specifically to an improved pier head that maintains some support to the coach even as the distance between the coach and the ground changes.

2. Description of the Related Art

The drawing labeled FIG. 1 PRIOR ART shows a portion of a typical conventional support structure for a mobile home coach. A plurality of rails or support beams, such as beam 10, are attached to the underside of the coach to provide a level platform for supporting the coach body. Beam 10 is typically an I-beam, as shown, but may be a C-beam or other configuration having a large bottom flange 12 that carries the moment forces.

A coach sixty feet long and twelve feet wide typically has two parallel spaced-apart sixty foot beams 10 running the length of the coach. A furnished sixty foot by twenty foot coach weighs in the range of 22,000 pounds. Beam 10, or the like, is supported off the ground by jack stands or piers, denoted generally as 20. Each pier 20 includes a stand, denoted generally as 21, for placement on the ground and a head, denoted genesally as 30P, for placement under a load to be supported. Stand 21 includes height adjustment means, denoted generally as 22, such as threaded rod 23 and adjustment nut 24. Head 30P includes a support plate 50P for placement under I-beam flange 12 for supporting beam 10. Piers 20 are placed typically at five foot intervals such that, for the above example, twenty-two piers would be used and each pier 20 should support about one thousand pounds. Adjustment nut 24 adjusts the height of support plate 50P above the ground and is used to adjust the height of each pier such that beam 10 is uniformly supported in a level position. Since the height of each pier 20 affects the load of the other piers 20, it is difficult to uniformly align all of the platforms 22 supporting beam 10 such that beam 10 is level. The difference between a given pier supporting one thousand pounds or zero pounds may be a partial turn of the adjusting nut 24 of that pier or an adjacent pier.

A major problem with the above-described conventional practice is that the levelness of beam 10 at a given location may not be an accurate indication that the beam is being supported at that location. Additionally, with passage of time, because of ground settling and other factors, some piers 20 carry no load and some carry a very large load. It is not uncommon to be able to simply pull out by hand one-third to one-one half of piers 20 because they are carrying no load. This condition is undesirable for several reasons. The large stresses in the few load carrying piers 20 may result in failure during an earthquake or the like. The coach frame will tend to bend in the unsupported areas such that the coach body is distorted and interior floors are bowed.

Therefore, it is desirable to have an improved pier that will maintain a desired load even after increased separation between ground and coach.

It is also desirable that with such an improved pier, any increased separation between ground and coach is easily observable, thus indicating that corrective action should be taken.

SUMMARY OF THE INVENTION

This invention is a load equalizing pier for a coach. The pier comprises a stand for placement on the ground and a head for placement under a load. The stand includes means for adjusting the height of the head. The improvement lies in the head. The head includes a base plate for attachment to the top of the stand and a support plate for placement under a load. Springs, supported by the base plate bias the support plate toward a biased position separated from the base plate. Bolts retain the support plate to the base plate above the base plate such that the support plate is movable downward from a biased position to a stop position restrained by the base plate.

The springs apply a biasing force less than the desired load such that said support plate, under desired load, is restrained from further downward movement by said base plate. Preferably, the springs apply a biasing force of less than half of the desired load.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
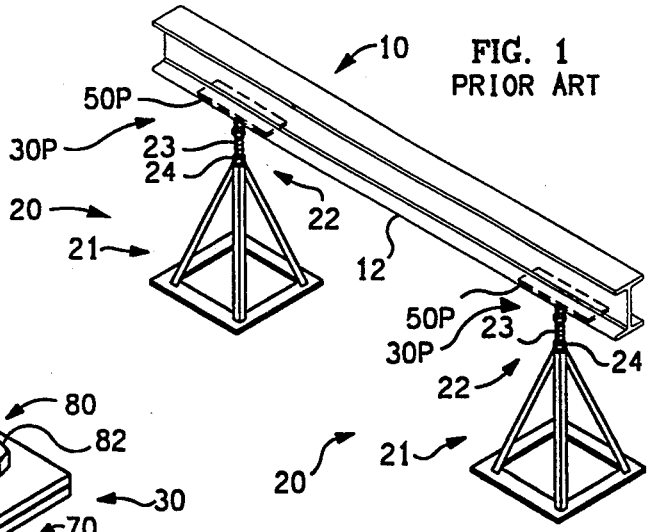
FIG. 1 PRIOR ART
FIG. 1 PRIOR ART is a perspective view of typical piers of the prior art supporting a beam.
Figure 2:
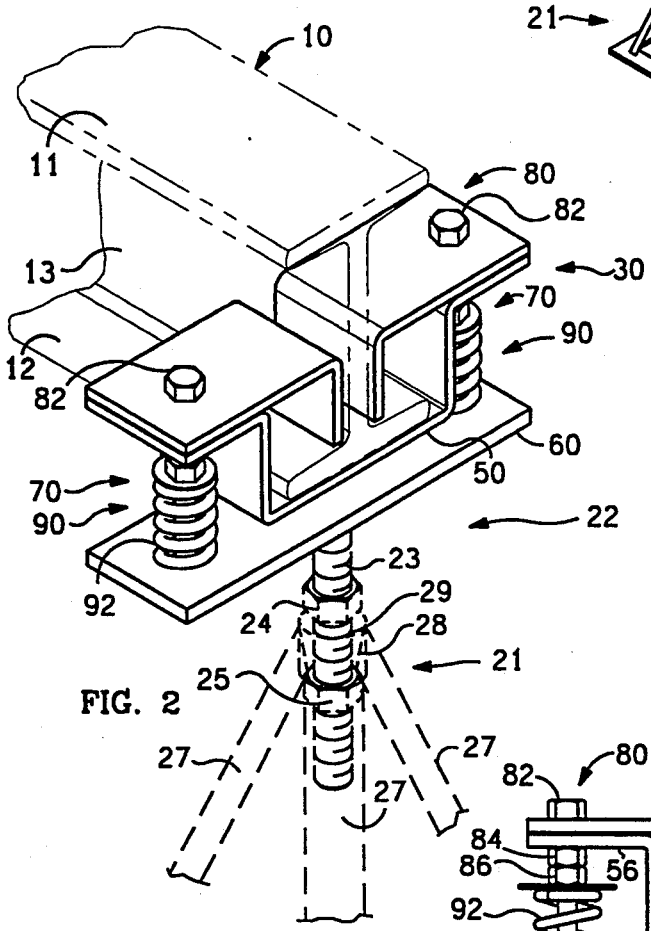
FIG. 2 is a perspective view of a preferred embodiment of the pier head of the invention shown attached to a coach I-beam. The pier stand struts and apex collar are shown in phantom.
Figure 3:
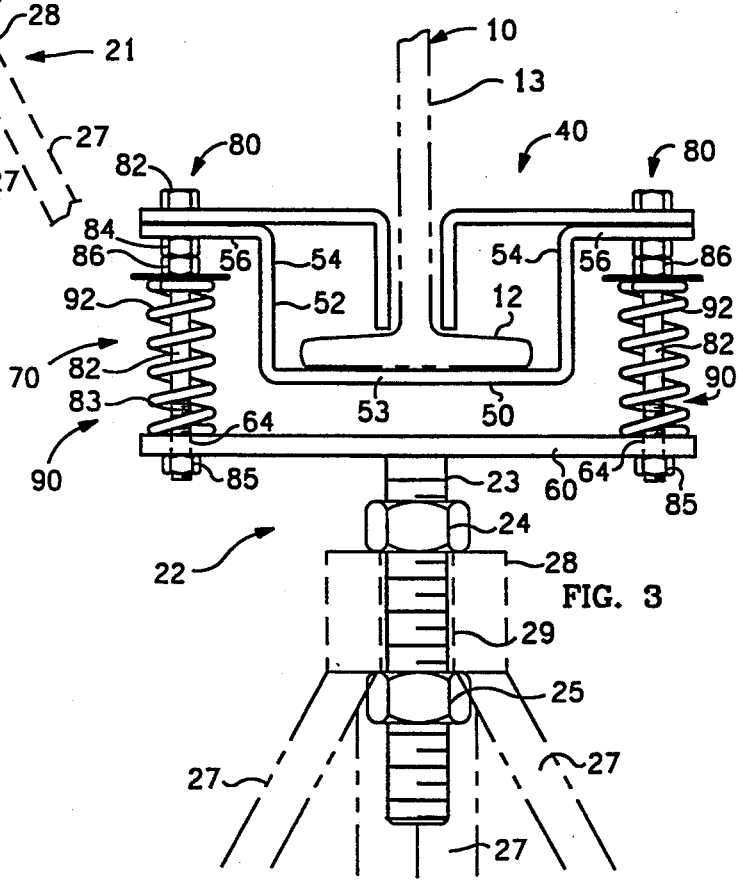
FIG. 3 is an enlarged front view of FIG. 2.

With reference now to the drawings of the current invention, FIG. 2 is a perspective view of a preferred embodiment of a pier head, denoted generally as 30, of the invention shown clamped to a coach I-beam 10 (shown in phantom) and attached to the top of a pier stand 21 (partially shown in phantom), and FIG. 3 is an enlarged front view of FIG. 2.

I-beam 10, shown, generally comprises a top flange 11 and bottom flange 12 separated by web 13. Although I-beam 10 is shown and described, it will be seen that the invention is easily adaptable for use other beams, such as C-channels.

The top of pier stand 21, shown in phantom, includes support struts 27 and apex collar 28 with through bore 29. Height adjustment means, denoted generally as 22 includes threaded rod 23 freely passing through bore 29 with retaining nut 25 threaded thereto securing it beneath collar 28 and adjustment nut 24 threaded thereto adjusting its top height above collar 28, thereby adjusting the height of head 30.

Pier head 30 includes a base plate 60 that is attached to the top of pier stand 21 by suitable means, such as by welding to the top of adjustment rod 23. Base plate 60 is a strong rigid member made out of steel or other suitable material.

A support plate 50, also of strong rigid material such as steel, is placed under the load, e.g. I-beam 10.

Retaining and biasing means, denoted generally as 70, includes retaining means, denoted generally as 80 and resilient biasing means, denoted generally as 90. In the preferred embodiment shown in FIGS. 2 and 3, biasing means 90 includes a resilient spring, such as a pair of coil springs 92, supported by base plate 60 and upwardly biasing support plate 50 such that, under no load, support plate 50 is separated from base plate 60. Retaining means 80 retains support plate 50 to base plate 60 above base plate 60 such that support plate 50 is movable vertically from a biased position separated from base plate 60 to a stop position restrained from downward movement by base plate 60. Springs 92 bias support plate 50 toward the separated position.

Retaining means 80 includes a rod, such as bolt 82, connecting plates 50,60 to one another and retaining support plate 50 to base plate 60 above base plate 60 such that support plate 50 is movable vertically from a biased position separated from base plate 60 to a stop position restrained from further downward movement. In the preferred embodiment, this is accomplished by passing shaft 83 of bolt 82 downward through bores in both plates 50,60 and attaching bolt 82 to support plate 50 with nut 84 and to base plate 60 with nut 85. Bolt 82 is freely journaled through bore 64 in base plate 60. In this manner, plates 50,60 can move vertically relative to one another through a given range and horizontal loads on support plate 50 are transferred to base plate 60 through bolts 82. Preferably, bolt 82 passes through the center of spring 92.

Other configurations of retaining and biasing means 70 are contemplated. In the simplest sense, a single large coil spring could accomplish most of the desired result.

Bolt 82 and nut 86 may be used as pre-loading means for preloading spring 92. Moving nut 86 downward on bolt shaft 83 compresses spring 92 to a first force such that a load on support plate 50 less than the first force will not further deflect spring 92 and does not result in further downward movement of support plate 50.

As seen in FIG. 3 in front view, support plate 50 includes a central U-shaped portion 52 including a horizontal section 53 supporting load 10 and vertical sections 54. Each vertical section 54 has a support flange 56 on its upper end. Nothing is between horizontal section 53 and base plate 60 such that under desired load, spring 92 deflects until support plate horizontal section 53 bears against base plate 60 and is restrained from further downward movement. Other configurations of base plate 60 and support plate 50 are contemplated that accomplish this same result.

A clamp, denoted generally as 40, is removably attached to support plate 50 such as by bolt 82 and clamping support plate 50 to the load to be supported, in this case to bottom flange 12 of I-beam 10. In the embodiment shown, clamp 40 comprises a pair of brackets, each having a horizontal leg and a vertical leg. The vertical leg bears against the top of flange 12. If a C-beam is supported, only one clamp 40 is used and the other is removed.

A typical average coach pier 20 supports about one thousand pounds. Preferably, springs 82 are selected to support a portion of this load, say two hundred to four hundred pounds. For example, if it is desired to know when the pier is supporting less than four hundred pounds, springs are chosen such that, upon installation of pier 20 as the height of pier 20 is adjusted upward, springs 82 compress and support plate 50 moves closer to base plate 60 until support plate 50 encounters base plate 60 and is prevented from further downward movement, it is known at this moment that pier 20 is supporting four hundred pounds. If less load is supported later, the plates 50,60 will separate. This separation can be easily seen by visual inspection.

Proper springs must be selected. If springs are selected to support all of the load, the load is constantly spring supported and will rock with earthquakes or with wind gusts. This is highly undesirable and may be dangerous. If springs support nearly all of the load, slight changes in loading change piers to the spring mode wherein the load will bounce with movement of persons across the floor. This is also undesirable.

For these reasons, it is desirable that the springs support only a portion of the load. It has been found preferable that the springs support about one-fourth to one-third of the total desired load on the pier. With use of such springs, large discrepancies in loading are readily apparent, yet most load changes will not make the load spring supported; therefore the load will remain stable.

Having described the invention, it can be seen that it provides a very convenient device for providing at least as minimum loading for each pier and for providing an easily seen visual indication of large negative changes in loading.

Although a particular embodiment of the invention has been illustrated and described, various changes may be made in the form, composition, construction, and arrangement of the parts without sacrificing any of its advantages. Therefore, it is to be understood that all matter herein is to be interpreted and illustrative and not in any limiting sense and it is intended to cover in the appended claims such modifications as come within the true spirit and scope of the invention.

I claim:

1. A load equalizing pier head for attachment to a pier stand; the load equalizing pier head comprising:
   - a base plate for attachment to the top of a pier stand, the pier stand including means for adjusting the height of said attached base plate;
   - a support plate for placement under a load;
   - a retainer retaining said support plate to said base plate above said base plate such that said support plate is movable vertically from a biased position separated from said base plate to a stop position restrained by said base plate;
   - a resilient biasing device supported by said base plate; said resilient biasing device providing a biasing separation force between said base plate and said support plate such that with no load on said support plate said support plate is separated from said base plate and such that said support plate, under a predetermined load, bears against said base plate.

2. The load equalizing pier head of claim 1 wherein: said retainer transfers horizontal loads on said support plate to said base plate when said support plate is separated from said base plate by said resilient biasing device.

3. The load equalizing pier head of claim 1 wherein: said retainer includes a rod fastened to one of said plates and freely journaled through a bore in the other said plate.

4. The load equalizing pier head of claim 3 wherein: said resilient biasing device includes a coil spring having an open center; and said rod passes through the center of said spring.

5. The load equalizing pier head of claim 1 including: pre-loading means for pre-loading said resilient biasing device to a pre-loading force such that a load on said support plate less than said pre-loading force will not deflect said resilient biasing device.

6. The load equalizing pier head of claim 1 wherein: said resilient biasing device is a plurality of coil springs.

7. The load equalizing pier head of claim 1 including: a clamp attached to said support plate for clamping said support plate to the load to be supported.

* * * * *